US008170243B2

(12) United States Patent
Kondo et al.

(10) Patent No.: US 8,170,243 B2
(45) Date of Patent: May 1, 2012

(54) AUDIO OUTPUT APPARATUS AND VIBRATOR

(75) Inventors: Tetsujiro Kondo, Tokyo (JP); Akihiko Arimitsu, Kanagawa (JP); Junichi Shima, Tokyo (JP); Takuro Ema, Tokyo (JP)

(73) Assignee: Sony Corporation, Tokyo (JP)

( * ) Notice: Subject to any disclaimer, the term of this patent is extended or adjusted under 35 U.S.C. 154(b) by 450 days.

(21) Appl. No.: 12/391,460

(22) Filed: Feb. 24, 2009

(65) Prior Publication Data

US 2009/0232333 A1 Sep. 17, 2009

(30) Foreign Application Priority Data

Mar. 14, 2008 (JP) ..... 2008-066449

(51) Int. Cl.
*H04R 25/00* (2006.01)

(52) U.S. Cl. ..... 381/162; 381/152

(58) Field of Classification Search ..... 381/162, 381/600, 152, 431, 423, 337, 398, 107, 150, 381/304
See application file for complete search history.

(56) References Cited

U.S. PATENT DOCUMENTS

| | | | |
|---|---|---|---|
| 2005/0157905 | A1 | 7/2005 | Beer et al. |
| 2007/0092092 | A1 * | 4/2007 | Kondo et al. ..... 381/152 |

FOREIGN PATENT DOCUMENTS

| | | |
|---|---|---|
| JP | 63-155997 | 6/1988 |
| JP | 11-225384 | 8/1999 |
| JP | 2001-119790 | 4/2001 |
| JP | 2002-196687 | 7/2002 |
| JP | 2003-153357 | 5/2003 |
| JP | 2004-289443 | 10/2004 |
| JP | 2005-183565 | 7/2005 |
| JP | 2005-311481 | 11/2005 |
| JP | 2006-500803 | 1/2006 |
| JP | 2006-130191 | 5/2006 |
| JP | 2007-116422 | 5/2007 |
| JP | 2007-243851 | 9/2007 |
| JP | 2007-322740 | 12/2007 |
| JP | 2008-11340 | 1/2008 |
| WO | WO 2007/026534 A1 | 3/2007 |

OTHER PUBLICATIONS

U.S. Appl. No. 12/064,964, filed Feb. 27, 2008, Kondo, et al.

* cited by examiner

*Primary Examiner* — Thomas L Dickey
*Assistant Examiner* — Fazli Erdem
(74) *Attorney, Agent, or Firm* — Oblon, Spivak, McClelland, Maier & Neustadt, L.L.P.

(57) ABSTRACT

An audio output apparatus is provided. The audio output apparatus includes: a vibration member, a vibrator, a vibrator positioning unit, and a vibrator-depth positioning unit. The vibration member vibrates to output a sound. The vibrator is in contact with the vibration member and detachably attached thereto to allow the vibration member to vibrate in response to an input audio signal. The vibrator positioning unit controls a contact position between the vibrator and the vibration member. The vibrator-depth positioning unit adjusts a position of the vibrator in the direction of being pressed against the vibration member and brought into contact with the vibration member.

14 Claims, 15 Drawing Sheets

AUDIO OUTPUT APPARATUS AND VIBRATOR

CROSS REFERENCES TO RELATED APPLICATIONS

The present invention contains subject matter related to Japanese Patent Application JP 2008-066449 filed in the Japanese Patent Office on Mar. 14, 2008, the entire contents of which being incorporated herein by reference.

BACKGROUND OF THE INVENTION

1. Field of the Invention

The present invention relates to an audio output apparatus which is suitably applicable to, for example, a flat panel speaker. Specifically, the present invention relates to an audio output apparatus in which the position of a vibrator can be optionally shifted from one to another on a vibration member and to a vibrator to be attached to such an audio output apparatus.

2. Description of the Related Art

Audio output apparatuses that output a sound by allowing vibrators to vibrate plate-shaped flat panels (vibration members) have been widely known in the art. Such audio output apparatuses can spread sound over wider areas than cone-shaped audio output apparatuses and thus have advantages that the sweet spots (optimum listening areas) thereof are wide.

In order to more accurately reproduce audio input, there has been a demand for an audio output apparatus to have frequency characteristics as flat as possible. That is, when an audio signal for sound whose volume (audio level) is constant at every frequency is input to an audio output apparatus and is reproduced, the closer the sound volume (audio level) at every frequency of sound reproduced by the audio output apparatus comes to a constant volume, the more accurately the audio output apparatus can reproduce the input audio.

In the audio output apparatus using a flat panel as a vibration member, the quality and spread of output sound may vary with a change in location of a vibrator to be brought into contact with the vibration member or in amount of force for pressing the vibrator against the vibration member. To realize more flat frequency characteristics, the related-art audio output apparatus uses two or more vibration members with different locations of vibrators to respectively output sounds with different frequency characteristics (for example, see Japanese Unexamined Patent Application Publication No. 2007-116422 (JP 2007-116422 A). In this case, the locations of the respective vibrators are previously defined so that the frequency characteristics of output sound become more flat when the sound is simultaneously output from the respective vibration members. In addition, the arrangement of each vibrator on a predetermined position allows an audio output apparatus to output sound with the more desirable quality.

SUMMARY OF THE INVENTION

In a related-art audio output apparatus as described above, a vibrator is fixed to a vibration member using an adhesive or the like after determining the position of the vibrator. Therefore, in order to adjust the quality of sound to a desired level, the user has been urged to remove the vibrator attached once and then reattach the vibrator after adjusting the position thereof. In other words, there is a disadvantage in that the user may not readily adjust the quality of sound by positioning of the vibrator.

It is desirable to provide an audio output apparatus which can adjust the quality of sound readily by suitably positioning a vibrator and to provide a vibrator used in such an audio output apparatus.

According to an embodiment of the present invention, there is provided an audio output apparatus that includes a vibration member and a vibrator. The vibration member is provided for outputting a sound as a result of being vibrated. The vibrator is designed to be brought into contact with the vibration member and detachably attached to the vibration member. The vibrator allows the vibration member to vibrate in response to an input audio signal. The audio output apparatus further includes a vibrator positioning unit and a vibrator-depth positioning unit. The vibrator positioning unit controls a position at which the vibrator is in contact with the vibration member. The vibrator-depth positioning unit adjusts the position of the vibrator in the direction of pressing the vibrator against the vibration member to make a contact between them.

As the audio output apparatus is configured as described above, the location of the vibrator on the vibration member can be adjusted by the vibrator positioning unit.

According to the embodiment of the present invention, the vibrator positioning unit adjusts the location of the vibrator on the vibration member. Thus, the adjustment of sound quality, which is to be adjusted by the positioning of the vibrator, can be readily performed.

BRIEF DESCRIPTION OF THE DRAWINGS

FIG. 4A is a cross-sectional view and FIG. 4B is a perspective view of the vibrator.

FIG. 5A is a front view and FIG. 5B is a top view of the frame.

FIG. 12A is a side view and FIG. 12B is a cross-sectional view of the vibrator.

DESCRIPTION OF THE PREFERRED EMBODIMENTS

Hereinafter, embodiments of the present invention will be described with reference to accompanying drawings.

Figure 1:
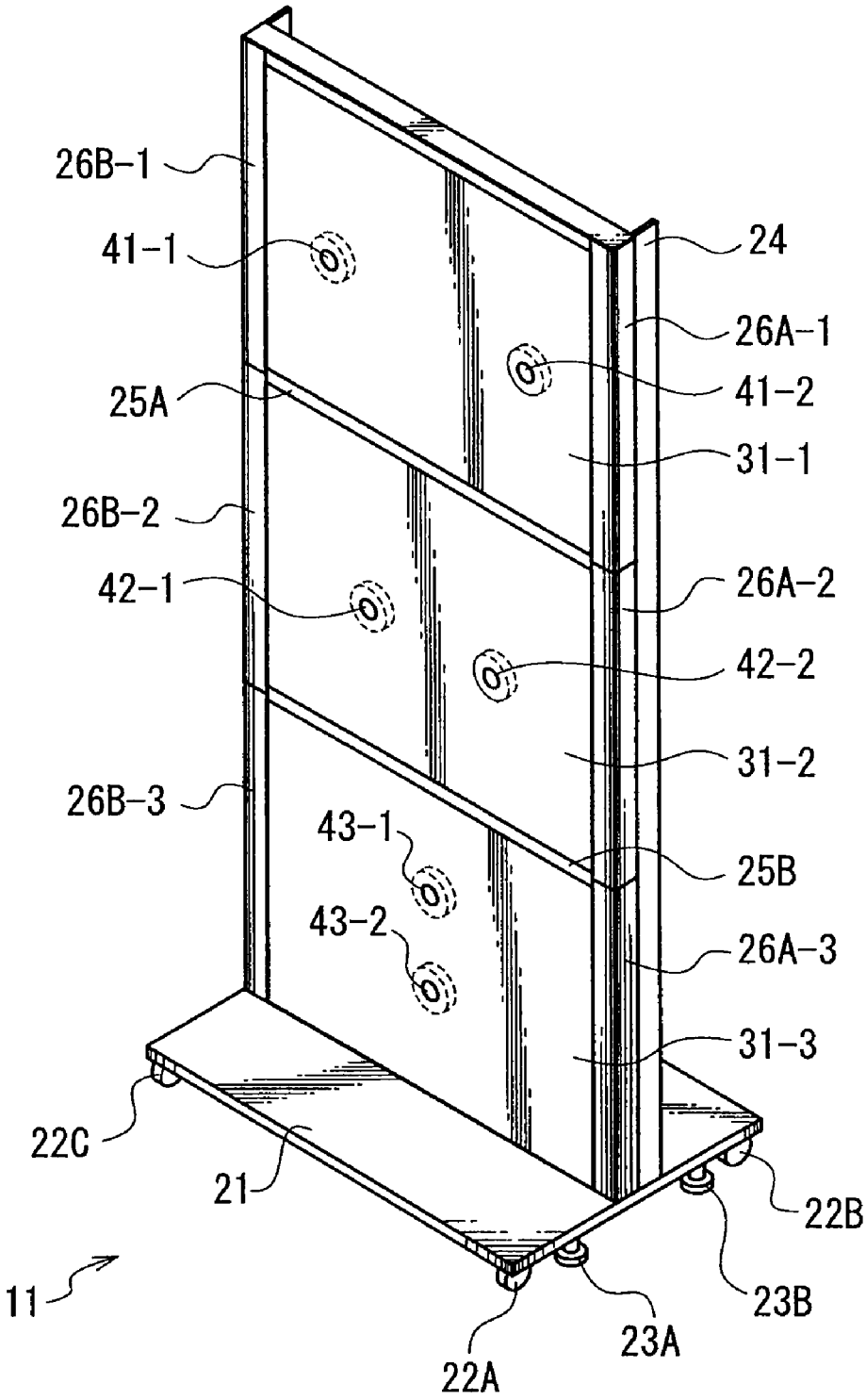
FIG. 1 is a perspective view illustrating an example configuration of a screen speaker apparatus according to an embodiment of the present invention.

FIG. 1 is a perspective view illustrating the appearance of a screen speaker apparatus 11 according to an embodiment of the present invention. The screen speaker apparatus 11 is an example of audio output apparatus, functioning as a speaker as well as a screen.

The screen speaker apparatus 11 includes a base 21, wheels 22A to 22D, apparatus supports 23A to 23D, a frame 24, load-bearing vibration member supports 25A and 25B. The screen speaker apparatus 11 further includes depth-direction vibration member supports 26A-1 to 26A-3 and 26B-1 to 26B-3, vibration members 31-1 to 31-3, and vibrators 41-1, 41-2, 42-1, 42-2, 43-1, and 43-2.

The base 21 is made of, for example, a material with sufficient strength to support the frame 24, such as iron, aluminum, magnesium, or titanium. As shown in FIG. 1, the wheels 22A to 22D (the wheel 22D is not shown) are provided at the four corners of the base 21 on the lower surface thereof. Furthermore, in the vicinity thereof, the apparatus supports 23A to 23D (the apparatus supports 23C and 23D are not shown) are provided. For example, when the screen speaker apparatus 11 set in a room is pushed by a user, each of the wheels 22A to 22D rotates on the floor surface, causing the screen speaker apparatus 11 to move in the pushing direction. In addition, each of the apparatus supports 23A to 23D is in contact with the floor surface so that the screen speaker apparatus 11 can stand in place.

In other words, the user may move and place the screen speaker apparatus 11 at a desired position.

The frame 24 is fixed on the upper surface of the base 21 by welding or the like and arranged to stand upright on the base 21.

In addition, the frame 24 fixes the load-bearing vibration member supports 25A and 25B for holding the vibration members 31-1 to 31-3 in a direction in which a load is applied (in the downward direction in FIG. 1). The frame 24 fixes the depth-direction vibration member supports 26A-1 to 26A-3 and 26B-1 to 26B-3 for holding the vibration members 31-1 to 31-3 in a depth direction in FIG. 1. Thus, the vibration members 31-1 to 31-3 are detachably fixed to the frame 25 using these supports 26A-1 to 26A-3 and 26B-1 to 26B-3, respectively.

In other words, the weight of the vibration member 31-1 is supported by the load-bearing vibration member support 25A. In the depth direction, the vibration member 31-1 is supported by the depth-direction vibration member supports 26A-1 and 26B-1. Similarly to the vibration member 31-1, the weight of the vibration member 31-2 is supported by the load-bearing vibration member support 25B. In the depth direction, the vibration member 31-2 is supported by the depth-direction vibration member supports 26A-2 and 26B-2. The vibration member 31-3 is supported by the upper side of the frame 24, and the depth-direction vibration member supports 26A-3 and 26B-3.

As described above, each of the vibration members 31-1 to 31-3 is detachably fixed in the vertical direction to the frame 24 and therefore the screen speaker apparatus 11 can serve as a screen with a predetermined height from the floor surface.

Furthermore, the vibration members 31-1 to 31-3 are arranged side by side in the vertical direction so that the vibration member 31-2 is positioned at the same height (the height illustrated in the vertical direction in FIG. 1) as that of the listener's ears listening to sounds output from the screen speaker apparatus 11.

The vibration members 31-1 to 31-3 are formed from plasterboard, wood such as an MDF (Medium-Density Fiberboard), an aluminum plate, a carbon plate, or a resin plate such as acryl plate. Alternatively, the vibration members 31-1 to 31-3 may be a plate made of a material such as glass. The vibration members 31-1 to 31-3 may also be made of composite materials in which different materials are combined (laminated).

As illustrated in FIG. 1, the screen speaker apparatus 11 includes three vibration members 31-1 to 31-3. However, according to an embodiment of the present invention, the number of vibration members is not limited to three. Alternatively, one or more vibration members may be detachably fixed to the frame 24. In other words, the user may combine any number of vibration members in the vertical direction to provide the screen speaker apparatus 11 with a desired height.

In the example shown in FIG. 1, the vibration members 31-1 to 31-3 of the same size are arranged side by side in the vertical direction. Alternatively, they may also be arranged side by side in the horizontal direction or in the oblique direction. However, the vibration members 31-1 to 31-3 may preferably be arranged so that audio output from each of the vibration members 31-1 to 31-3 reaches the right and left ears of a listener at the same time.

Therefore, for example, when the listener stands in the vertical direction in FIG. 1 and listens to a sound output at a position where the listener views the screen speaker apparatus 11 from the front side thereof, the vibration members 31-1 to 31-3 may preferably be arranged side by side in the vertical direction, as shown in FIG. 1.

The vibrators 41-1 and 41-2 are mounted side by side in the horizontal direction in the vibration member 31-1 as shown in FIG. 1. The vibrators 42-1 and 42-2 are mounted side by side in the horizontal direction in the vibration member 31-2 as shown in FIG. 1. As shown in FIG. 1, the vibrators are mounted in the vibration members 31-1 and 31-2 so that the distance between the vibrator 42-1 and the vibrator 42-2 is shorter than the distance between the vibrator 41-1 and the vibrator 41-2. Furthermore, the vibrators 43-1 and 43-2 are mounted side by side in the vertical direction in the vibration member 31-3 as shown in FIG. 1.

In this way, the vibrators of the respective vibration members 31 are symmetrically arranged with respect to the predetermined positions, for example the centers of the respective vibration members 31. However, the locations of the vibrators on the respective vibration members 31 are different from each other. Thus, vibration positions of the respective vibration members 31-1 to 31-3 can be different from each other. Therefore, the frequency characteristics of audio output from the respective vibration members 31-1 to 31-3 being vibrated are different from each other. Note that the number of the vibrators mounted on each of the vibration members 31-1 to 31-3 may be one or three or more.

Each of the vibrators 41-1, 41-2, 42-1, 42-2, 43-1, and 43-2 is provided with a vibrator-moving mechanism 60 described later. In response to the user's operation or the like, each vibrator can move to any position in the horizontal direction, vertical direction, or depth direction of the corresponding vibration member 31-1, 31-2, or 31-3. In other words, an arrangement of the vibrators 41-1, 41-2, 42-1, 42-2, 43-1, and 43-2 shown in FIG. 1 is only provided as an example and not limited thereto. Thus, any of other arrangements may be employed.

In the screen speaker apparatus 11, for example, the vibrators 41-1 and 41-2, 42-1 and 42-2, and 43-1 and 43-2 driven by a sound source (not shown), such as an amplifier, cause the vibration members 31-1 to 31-3 to vibrate, respectively, in response to audio signals input from the sound source. Thus, each of the vibration members 31-1 to 31-3 outputs a sound. That is, the screen speaker apparatus 11 functions as a speaker that converts audio signals into a sound. That is, the screen speaker apparatus 11 functions as a speaker that converts audio signals into a sound.

In the following description, when the vibrator 41-1 and the vibrator 41-2 need not be distinguished individually, they will be simply referred to as a vibrator (or vibrators) 41. Similarly, when the vibrator 42-1 and the vibrator 42-2 need not be distinguished individually, they will be simply referred to as a vibrator (or vibrators) 42. In addition, when the vibrator 43-1 and the vibrator 43-2 need not be distinguished individually, they will be simply referred to as a vibrator (or vibrators) 43. Furthermore, when the vibrators 41-1, 41-2, 42-1, 42-2, 43-1, and 43-2 do not need to be distinguished from each other, it will be simply referred to as a vibrator (vibrators) 41.

In the following description, when the load-bearing vibration member supports 25A and 25B need not be distinguished individually, they will be simply referred to as a load-bearing vibration member support 25. When the depth-direction vibration member supports 26A-1 to 26A-3 need not be distinguished individually, they will be simply referred to as a depth-direction vibration member support 26A. When the depth-direction vibration member supports 26B-1 to 26B-3 need not be distinguished individually, they will be simply referred to as a depth-direction vibration member support 26B. When the depth-direction vibration member supports 26A-1 to 26A-3 and 26B-1 to 26B-3 need not be distinguished individually, they will be simply referred to as a depth-direction vibration member support 26. In the followings, when the vibration members 31-1 to 31-3 need not be distinguished individually, they will be simply referred to as a vibration member 31.

Figure 2:
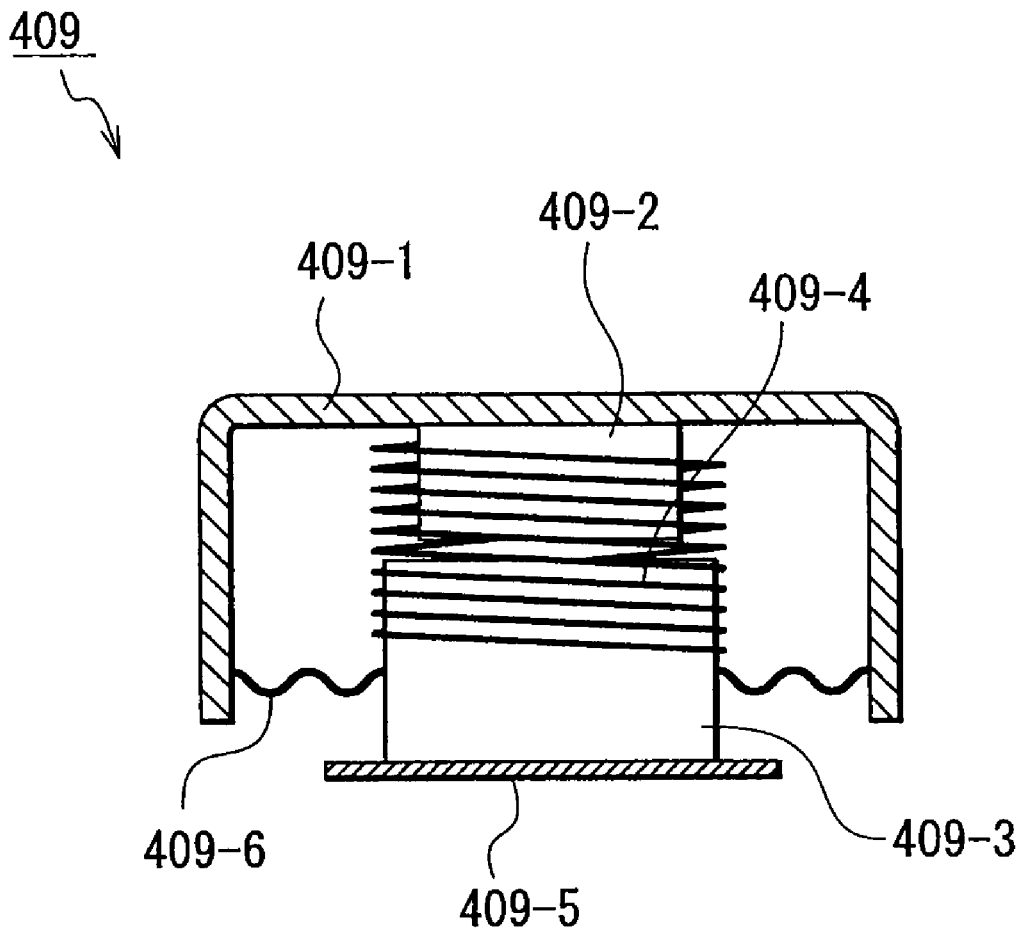
FIG. 2 is a side view of an example configuration of a vibrator according to an embodiment of the present invention.

FIG. 2 illustrates an example configuration of the vibrator 41. The vibrator 41 includes a vibration part 409 as shown in FIG. 2. The vibrator 41 also includes a support rod 410 but not shown in FIG. 2, which will be described later. The vibration part 409 includes a magnet 409-2 housed in a case 409-1, a coil bobbin 409-3 arranged close to the magnet 409-2, and a coil 409-4 wound around the coil bobbin 409-3. An end of the coil bobbin 409-3 is provided as a contact surface 409-5 in contact with a vibration member. The coil bobbin 409-3 is attached to the case 409-1 using a damper 409-6 so that the angle of the coil bobbin 409-3 can be changed. With such a configuration of the vibration part 409, a signal is applied to the coil 409-4 wound around the coil bobbin 409-3. A coil magnetic field generated upon receiving the signal acts with a bias magnetic field of the magnet 409-2, causing the vibration member 31 in contact with the contact surface 409-5 to vibrate.

Figure 3:
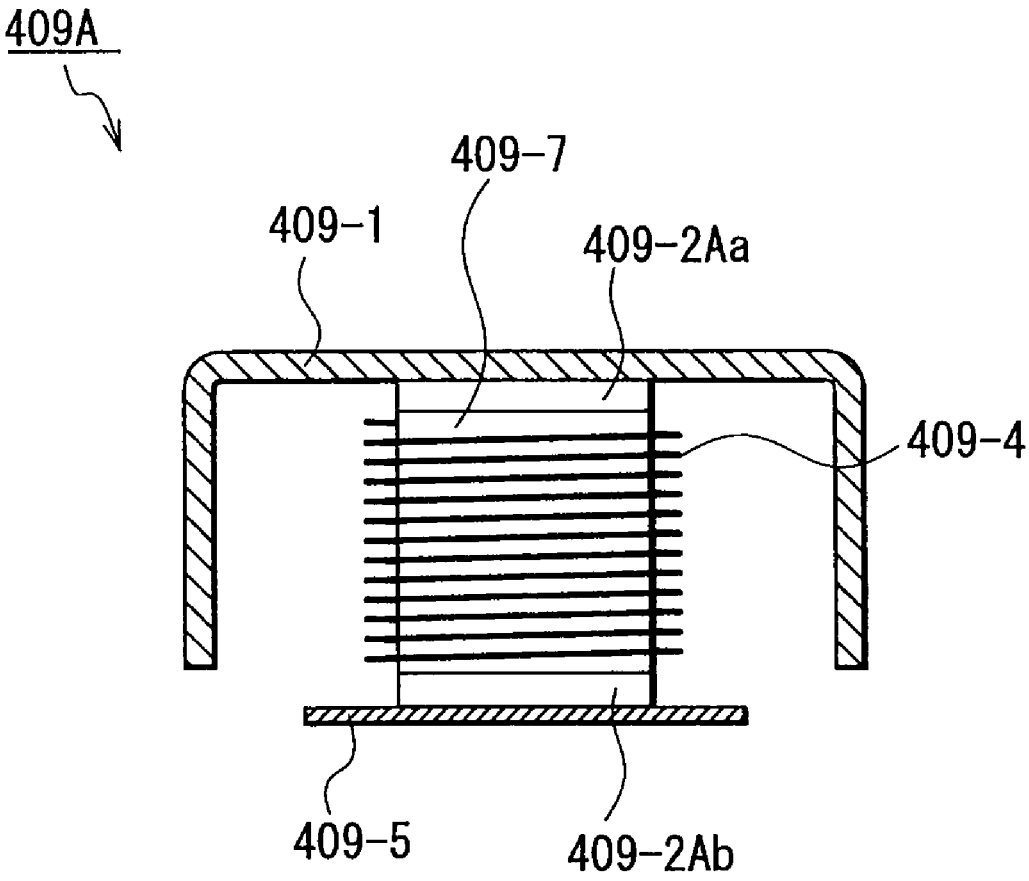
FIG. 3 is a side view of an example configuration of a vibrator using a giant-magnetostrictive element according to an embodiment of the present invention.

The configuration of the vibration part 409 is not limited to the example shown in FIG. 2, and the vibration part 409 may be formed using a giant-magnetostrictive element. The giant-magnetostrictive element is a device with dimensions which vary at a rate of nano- or micro-second order in response to the applied magnetic field generated by a coil, magnet, or the like. FIG. 3 illustrates an example configuration of the vibration part 409 using a giant-magnetostrictive element.

The vibration part 409A shown in FIG. 3 includes a cylindrical giant-magnetostrictive element 409-7, magnets 309-2Aa and 409-2Ab that sandwich the giant-magnetostrictive element 409-7 while being in contact with the opposite sides thereof, and a coil 409-4 wounded around the giant-magnetostrictive element 409-7. In addition, the magnet 409-2Aa is attached to a case 409-1 and the magnet 409-2Ab is attached to a contact surface 409-5. With the vibration part 409A formed as described above, a signal is supplied to the coil 409-4 to apply a bias magnetic field to the giant-magnetostrictive element 409-7 using the magnets 409-2Aa and 409-2Ab. Thus, a composite magnetic field formed of the bias magnetic field and the coil magnetic field allows the giant-magnetostrictive element 409-7 to extend and contract in the vertical direction. Subsequently, the extending and contracting movements of the giant-magnetostrictive element 409-7 are transmitted to the vibration member 31, causing the vibration member 31 to output a sound.

Thus, the vibration part 409A provided using the giant-magnetostrictive element 409-7 can output a sound at high frequencies of approximately 10 or more KHz via the vibration member 31.

Different vibrators can be used for respective frequencies of a sound to be output. In other words, the vibrator with the giant-magnetostrictive element 409-7 may be used for high-frequency audio output and the vibrator shown in FIG. 2 may be used for audio outputs at other frequencies. Combinations of different vibrators can be used.

In addition, the bias magnetic field may be applied to the giant-magnetostrictive element 409-7 in a manner different from that shown in FIG. 3. For example, the magnet 409-2 in the form of a hollow cylinder may be used and arranged to surround the periphery of the giant-magnetostrictive element 409-7, thereby applying a magnetic field.

Figure 4A:
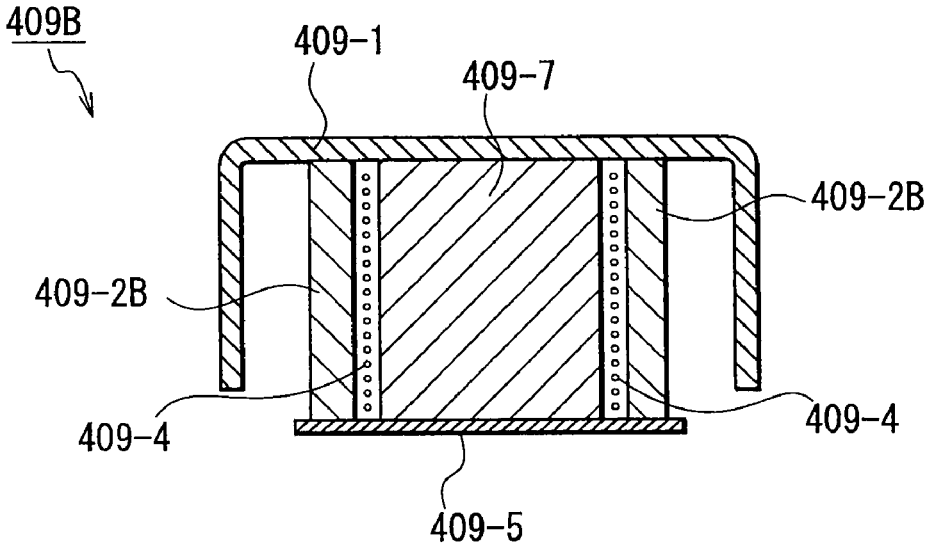
FIGS. 4A and 4B illustrate an example configuration of a vibrator using a giant-magnetostrictive element according to an embodiment of the present invention, where
Figure 4B:
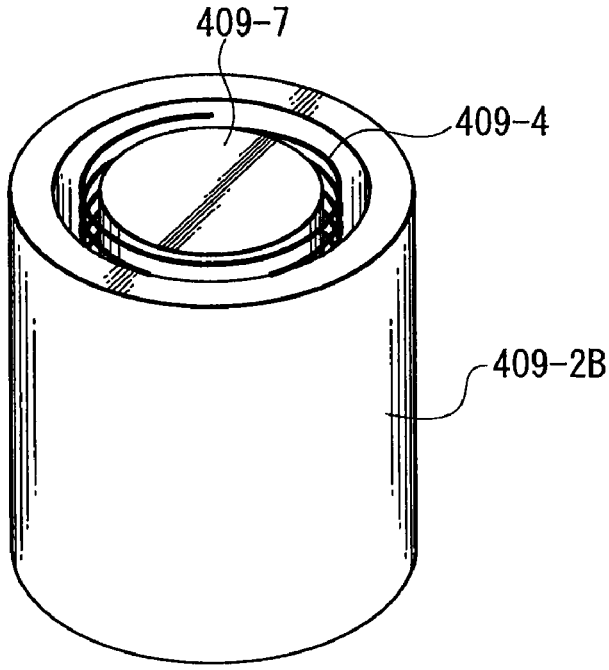

An example configuration of the vibration part 409B in such a case is represented in FIGS. 4A and 4B. FIG. 4A is a sectional view of the vibration part 409B. FIG. 4B is a perspective view of part of the vibration part 409B, showing the giant-magnetostrictive element 409-7, the coil 409-4, and a magnet 409-2B alone. In the vibration part 409B shown in FIGS. 4A and 4B, the coil 409-4 is wound around the periphery of the cylindrical giant-magnetostrictive element 409-7 and the magnet 409-2B in the form of a hollow cylinder is then arranged on the periphery of the resulting structure. Also in the case of such a configuration of the vibration part 409B, the giant-magnetostrictive element 409-7 can expand and contract in the vertical direction with the applied composite magnetic field of the bias magnetic field and the coil magnetic field. Subsequently, the extending and contracting movements of the giant-magnetostrictive element 409-7 are transmitted to the vibration member 31, causing the vibration member 31 to output a sound.

Figure 5A:
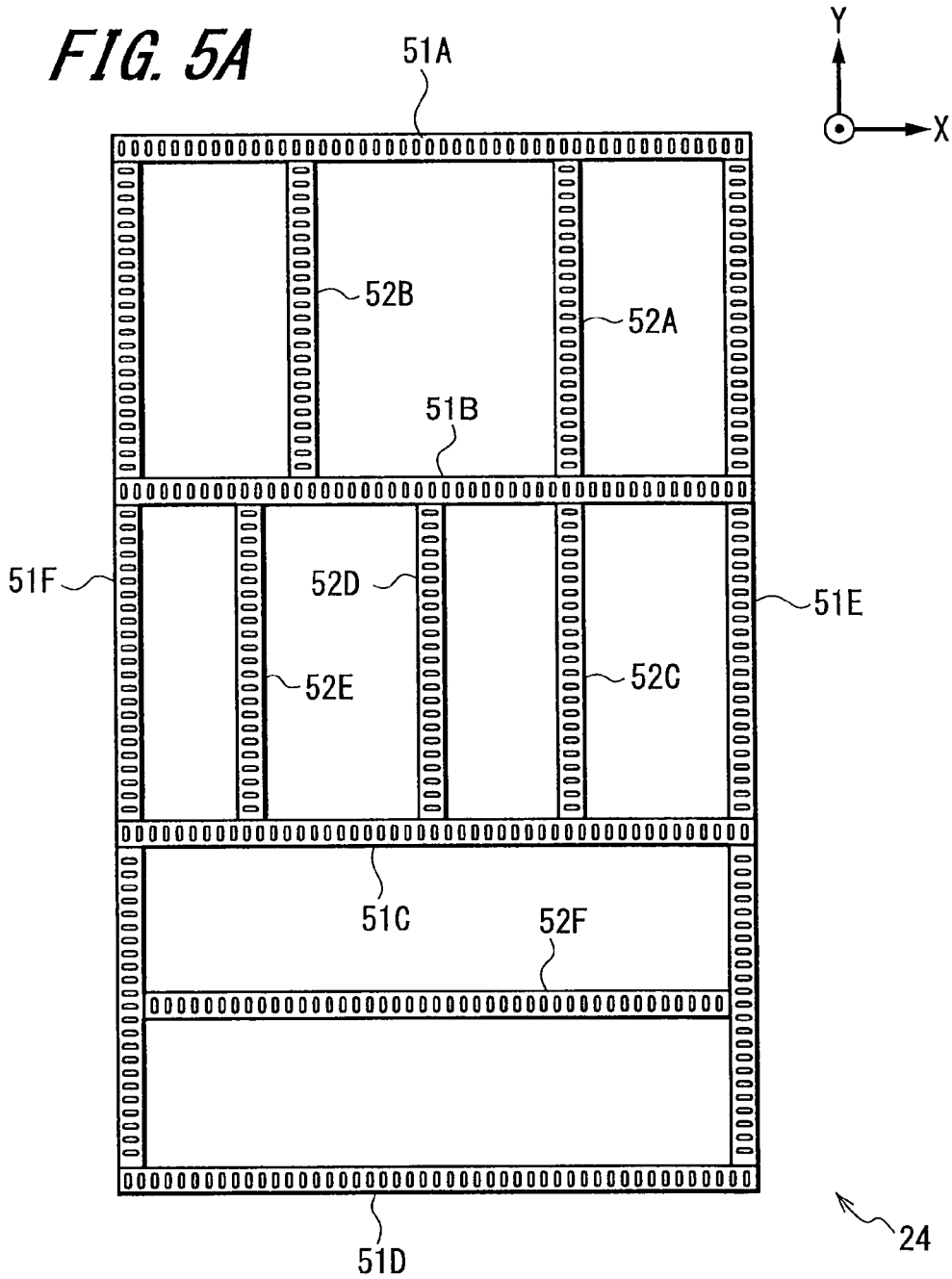
FIGS. 5A and 5B illustrate an example configuration of a frame according to an embodiment of the present invention, where
Figure 5B:
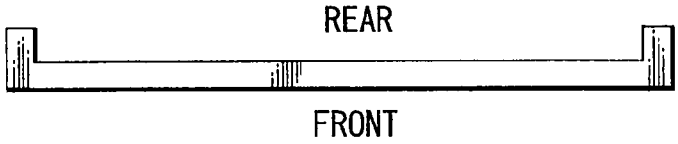

Next, with reference to FIGS. 5A and 5B, the frame 24 on which the vibration members 31 as described above and the vibrator-moving mechanism 60 are attached will be described in detail. FIG. 5A illustrates a front view (front side) of the frame 21 shown in FIG. 1 and FIG. 5B is a top view of the frame 21 shown in FIG. 1. As shown in FIG. 5B, the frame 24 has a U-shaped cross section of the side on which the vibration members 31 are fixed.

As shown in FIG. 5A, the frame 24 is designed to include main frames 51A to 51F and sub-frames 52A to 52F.

Each of the main frames 51A to 51F is made of a material such as a metal. In addition, the main frame 51D and the base 21 are fixed together by welding to allow the frame 24 to stand upright on the base 21.

Each of the main frames 51A to 51F is provided with long holes (or circular holes) at predetermined positions so that each of the sub-frames 52A to 52F can be optionally arranged. These long holes are formed at predetermined positions in the main frames 51A to 51F at equal intervals.

The main frames 51E and 51F are formed as L-shaped angle members and fixed by welding or the like to the corresponding straight members, the main frames 51A to 51D.

That is, the cross section of the frame 24 is U-shaped. Thus, the long holes formed in the front portion, and right and left side portions of the main frames 51E and 51F can be used in FIG. 5A. The load-bearing vibration member support 25 is fixed to predetermined long holes among them using bolts or the like. As a result, the vibration member support 25 is fixed to the main frame 51 to support the weight of the vibration member 31 thereon.

In addition, the sub-frames 52A to 52F can be fixed to the long holes formed in each of the main frames 51A to 51F using, for example, fasteners such as bolts and nuts. In other words, the sub-frames 52A to 52F are mounted on the main frames 51A to 51F, respectively, with fasteners.

That is, the user may detach any of the sub-frames 52A to 52F from the main frames 51A to 51F by removing the corresponding fasteners. In addition, for example, the user may optionally mount an additional sub-frame 52G (not shown) to any of the main frames 51A to 51F with fasteners.

By mounting the sub-frames 52A to 52F onto the main frames 51A to 51F, respectively, the strength of the frame 24 can be increased. Further, the sound quality can be changed by changing the size of the vibration member 31 and by reducing distortion of a sound by functioning to hold down the vibration member 31 in accordance with the resonance point of the vibration member 31, that is, by pressing the resonance point of the frequency of a sound to be output.

In other words, each of the sub-frames 52A to 52F is provided for, for example, suppressing the peak of the resonance point of the sound or shifting the frequency of the resonance point.

In the manner described above, in the screen speaker apparatus 11, the main frames 51A to 51F are mounted with the sub-frames 52A to 52F, respectively. As a result, the screen speaker apparatus 11 can reliably output a sound at a low frequency to a high frequency.

In the following description, when the main frames 51A to 51F need not be distinguished individually, they will be simply referred to as a main frame 51. When the sub-frames 52A to 52F need not be distinguished individually, they will be simply referred to as a sub-frame 52.

In the above-described example, the frame 24 is formed of six main frames 51A to 51F and six sub-frames 52A to 52F. According to an embodiment of the present invention, any desired number of main frames 51 and sub-frames 52 can be provided, and also, each of the main frames 51 and the sub-frames 52 can be arranged at any desired position.

Furthermore, the sub-frame 52 may also be mounted in the oblique direction to the main frame 51. Furthermore, the sub-frame 52 may also be formed, rather than in the linear shape, for example, in the shape of the letter L, in the shape of the letter T, or in the shape of the letter U.

Figure 6:
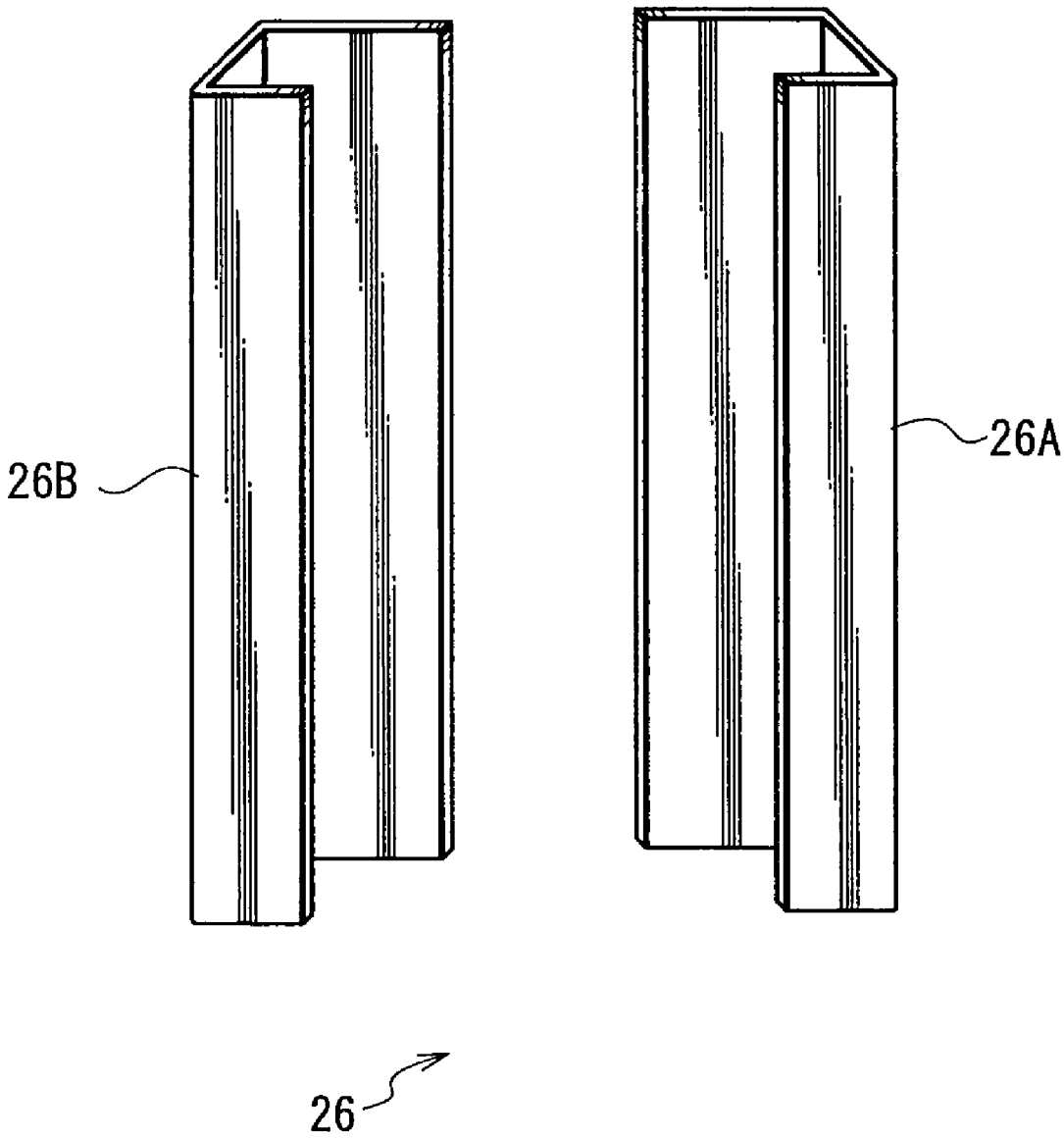
FIG. 6 is a perspective view illustrating an example configuration of a depth-direction vibration member support according to an embodiment of the present invention.

Next, with reference to FIG. 6, the details of the depth-direction vibration member support 26 will be described. The depth-direction vibration member support 26 is made of a material, such as a metal. As shown in FIG. 6, the depth-direction vibration member support 26 is U-shaped and detachably mounted to the frame 24.

The depth-direction vibration member support 26 utilizes its U-shape to support the vibration member 31 in the depth direction by sandwiching the vibration member 31 between the depth-direction vibration member supports 26A and 26B.

Figure 7:
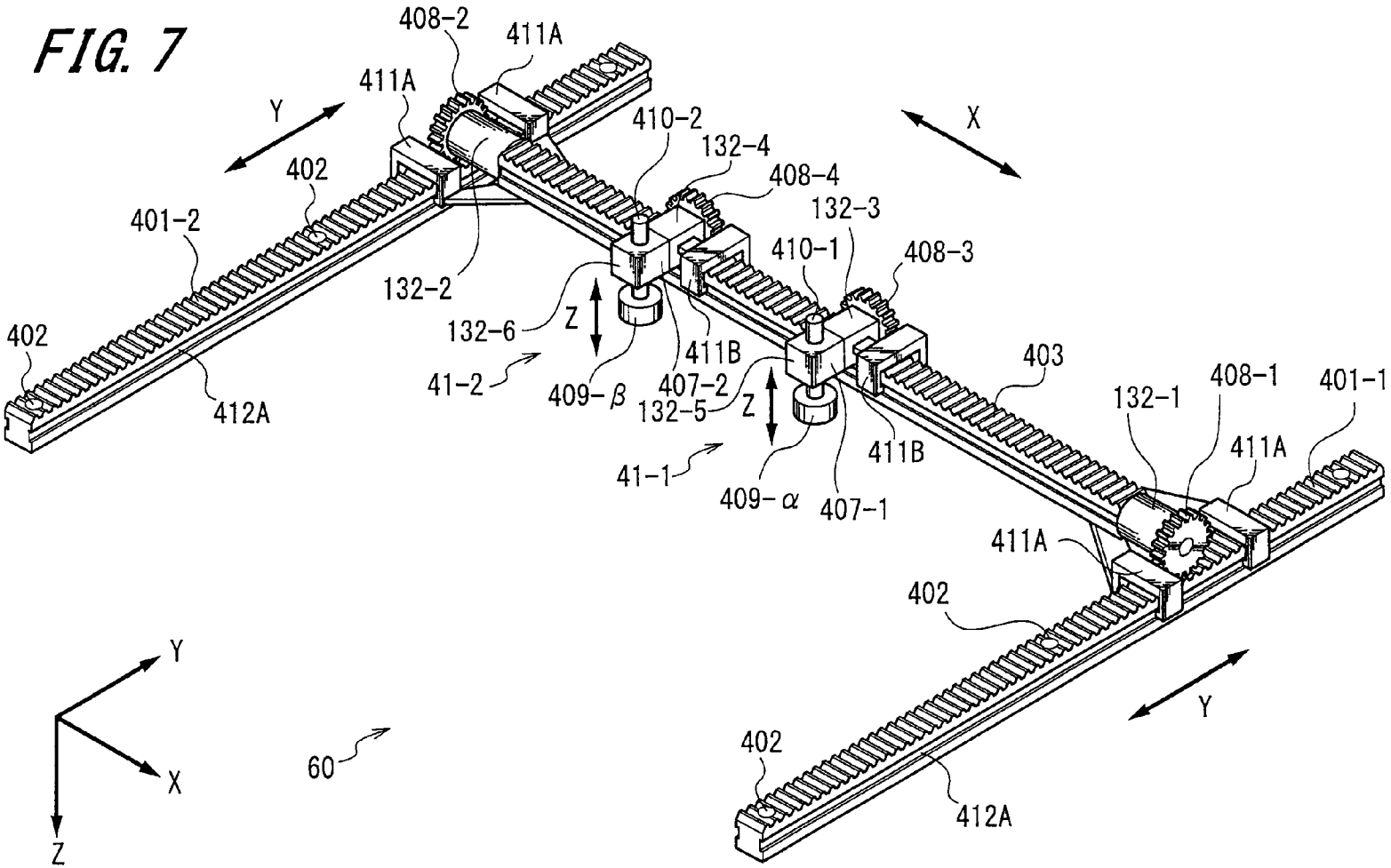
FIG. 7 is a perspective view illustrating an example configuration of a vibrator moving mechanism according to an embodiment of the present invention.

Referring to FIG. 7, the vibrator-moving mechanism 60 will be described in detail. The vibrator-moving mechanism 60 is a mechanism for moving the vibrators 41-1 and 41-2 to any positions in the horizontal direction (direction X in the figure), the vertical direction (direction Y in the figure), and the depth direction (the direction z in the figure) of the vibration member 31. Furthermore, the directions x, y, and z shown in FIG. 7 correspond to those shown in FIG. 5A, respectively.

The vibrator-moving mechanism 60 includes rails 401-1 and 401-2 as a mechanism for moving the vibrators 41-1 and 41-2 in the vertical direction (direction y). In addition, a rail 403 is attached at right angles to both the rails 401-1 and 401-2. Each of the rails 401-1 and 401-2 has a rack on one toothed side, so that the racks can be engaged with wheels 408-1 and 408-2 provided at both ends of the rail 403.

When the wheels 408-1 and 408-2 are driven by respective motors 132-1 and 132-2, the rail 403 moves along the rails 401-1 and 401-2 in the vertical direction.

Since the rails 401-1 and 401-2 are attached to the frame 24 while being stood vertically, the rail 403 arranged on both the rails 401-1 and 401-2 is forced in the gravity direction. Thus, jigs 411A for supporting the rail 403 are arranged on the upper and lower sides in the vertical direction of the wheels 408-1 and 408-2 provided at the ends of the rail 403.

The jigs 411A are designed to be fit in grooves 412A formed in sides of the respective rails 401-1 and 401-2 in the longitudinal direction to allow the jigs 411A to travel along with the movements of the wheels 408-1 and 408-2.

Vibrator-moving units 407-1 and 407-2 for moving horizontally the vibrators 41-1 and 41-2 are attached to the rail 403, respectively. The ends of the respective vibrator-moving units 407-1 and 407-2 are provided with wheels 408-3 and 408-4 that engage with a rack on the rail 403. In addition, a motor 132-3 for driving the wheel 408-3 is built in the vibrator-moving unit 407-1. Likewise, a motor 132-4 for driving the wheel 408-4 is built in the vibrator-moving unit 407-2. Therefore, the vibrator-moving units 407-1 and 407-2 can move horizontally on the rail 403 when the motors 132-3 and 132-4 respectively drive the wheels 408-3 and 408-4. Another jig 411B is arranged on one side of each of the vibrator-moving units 407-1 and 407-2 in the horizontal direction.

Furthermore, the vibrator 41-1 is formed of a vibration part 409-α in contact with the vibration member 31 and a cylindrical support rod 410-1 with a predetermined length. Also, the vibrator 41-2 is formed of a vibration part 409-β in contact with the vibration member 31 and a cylindrical support rod 410-2 with a predetermined length. In the following explanation, when the vibration parts 409-β and 409-β do not need to be distinguished from each other, they will be collectively referred to as vibration parts 409. In addition, when the support rods 410-1 and 410-2 do not need to be distinguished from each other, they will be correctively referred to as support rods 410.

The support rod 410 is mounted on a case 409-1 of the vibration part 409 (see FIGS. 2 to 4B) and extends perpendicularly to the contact surface 409-5. In addition, the support rod 410, while being movable in the depth direction (direction Z) of the vibration member 31, is held by the vibrator-moving unit 407-1 or 407-2. A motor 132 is built in the vibrator-moving unit 407. The motor 132 is responsible for moving the position at which the support rod 410 is held forward and backward in the depth direction to adjust the amount of pressing force of the vibration part 409 against the vibration member 31 (not shown in FIG. 7). The quality of sound output from the vibration member 31 varies depending on the amount of pressing force of the vibration part 409 against the vibration member 31. Thus, the user can adjust the sound quality by specifying the position of the vibration part 409 in the depth direction.

Furthermore, the positioning of the support rod 410 in the depth direction is also performed when moving the vibration part 409 to a predetermined position on the vibration member 31. That is, the support rod 410 is moved after moving the vibration part 409 away from the vibration member 31.

The motors 132 for moving the vibrators 41 to their respective positions in the horizontal, vertical, or depth directions are controlled in response to drive signals. The drive signals are generated by a control unit described later and supplied to the respective motors 132 according to position information input by the user through an operating unit or the like described later.

Furthermore, bolt holes 402 are formed in the rails 401-1 and 401-2 and arranged in the longitudinal direction thereof. Thus, the rails 401-1 and 401-2 can be fixed on the frame 24 by inserting fastening members into the respective bolt holes 402. Specifically, the rail 401-1 is mounted to the rear side of the main frame 51F (see FIG. 5A) and the rail 401-2 is mounted to the rear side of the main frame 51E, while keeping the rack-free side thereof facing front. The details of the mounting position of the vibrator-moving mechanism 60 on the frame 24 will be described later with reference to FIG. 8.

Figure 8:
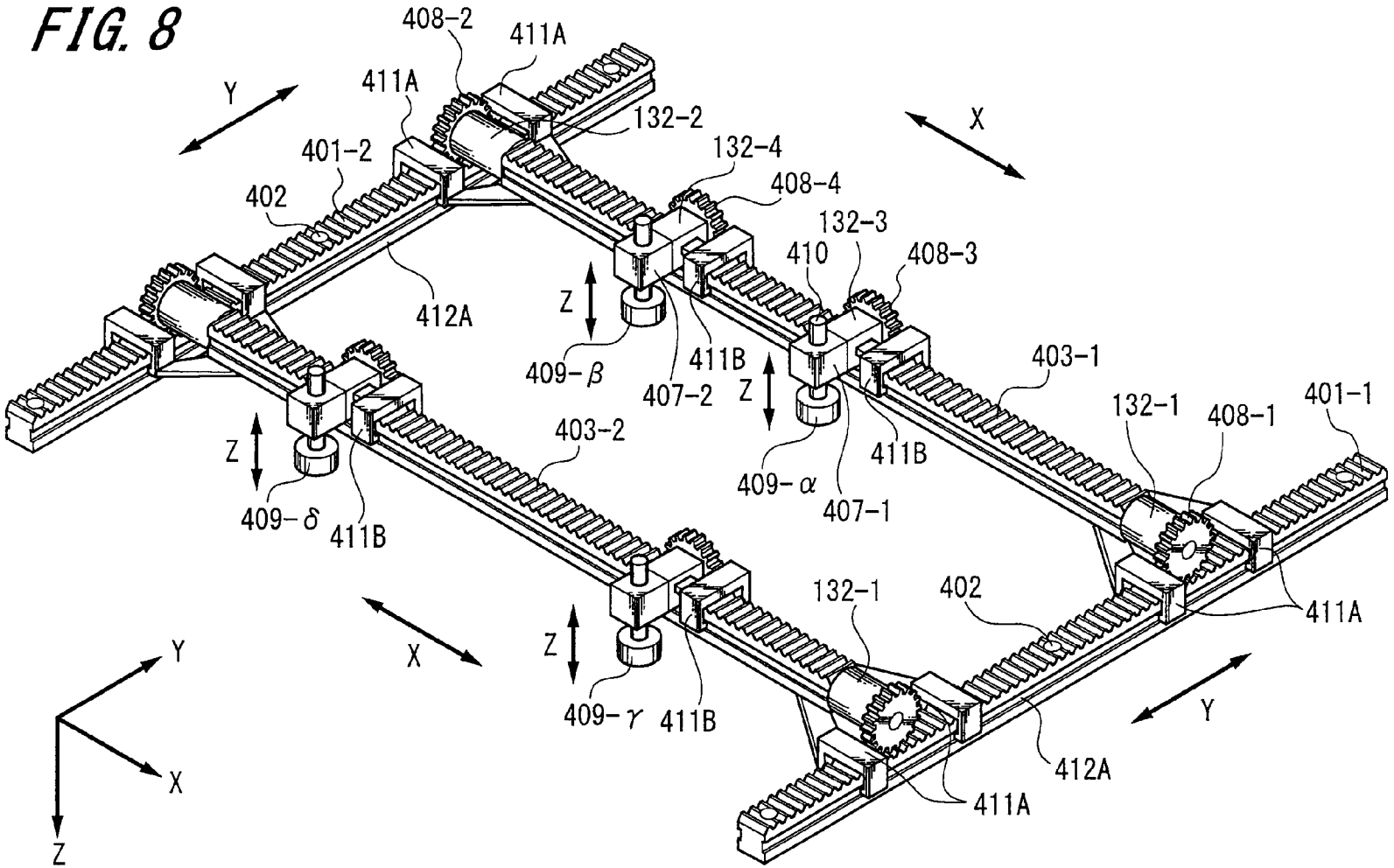
FIG. 8 is a perspective view illustrating an example configuration of a vibrator moving mechanism according to an embodiment of the present invention.

In the example shown in FIG. 7, there is provided one rail 403 in order to describe the configuration plainly. Alternatively, two or more rails 403 may be mounted. For example, as shown in FIG. 8, two rails 403-1 and 403-2 may be mounted. In this example, as shown in FIG. 1, four rails 403 are required because of four vibrators 41 arranged in the vertical direction of the screen speaker apparatus 11.

The mechanism for moving the vibrators 41 is not limited to one using the rail and the gear as shown in FIG. 7. Alternatively, it may be any of other mechanisms so long as it moves the vibrators 41 in the predetermined X, Y, or Z direction.

Figure 9:
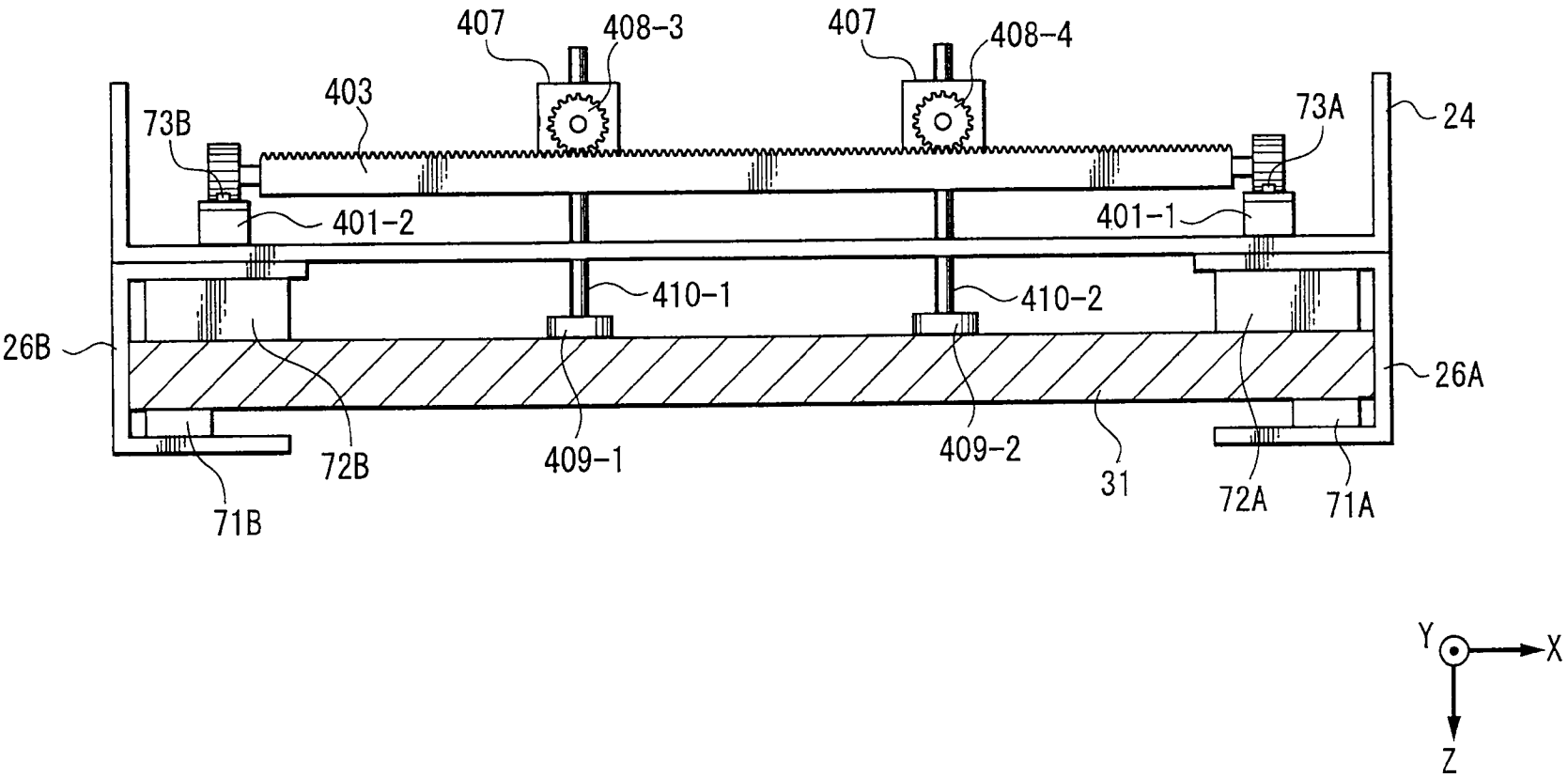
FIG. 9 is a side view of a frame on which a vibration member and a vibrator moving mechanism are attached according to an embodiment of the present invention.

Referring to FIG. 9, the details of the attaching of the vibrator-moving mechanism 60 to the frame 24 will be described. FIG. 9 is a top view of the screen speaker apparatus 11 where the vibrator-moving mechanism 60 and the vibration member 31 are attached to the frame 24. In FIG. 9, the lower side of the drawing indicates the front side of the screen speaker apparatus 11 and the upper side of the drawing indicates the rear side thereof.

As shown in FIG. 9, the depth-direction vibration member supports 26A and 26B are attached to the front of the frame 24 and the openings of their U-shaped cross sections face each other, sandwiching the vibration member 31. As shown in FIG. 9, the vibration member 31 is inserted between the depth-direction vibration member supports 26A and 26B. In this case, cushioning materials 71A, 71B, 72A, and 72B with predetermined shapes may be inserted between the depth-direction vibration member supports 26A, 26B and the vibration member 31. In other words, the vibration member 31 may be further placed between the cushioning materials 71A and 72A and also between the cushioning materials 71B and 72B.

Each of the cushioning materials 71A, 71B, 72A, and 72B is made of a certain material such as urethane (sponge) or rubber. In addition, the material may be adjusted to any hardness ranging from high to low corresponding to a desired sound quality or sound volume. The cushioning materials 71A and 71B are placed in front of the vibration member 31 and the cushioning materials 72A and 72B are placed behind the vibration member 31 to absorb a shock thereon, respectively. Therefore, the vibration member 31 can be protected from the shock.

That is, the cushioning materials 71A, 71B, 72A, and 72B act as a shock absorber for the vibration member 31, the frame 24, or the like to allow the vibration member 31 to readily vibrate, facilitating the generation of sound.

The vibrator-moving mechanism 60 is attached to the rear of the frame 24. The length of the support rod 410 attached to the vibrator-moving unit 407 is adjusted in the depth direction (direction Z) to bring the vibration part 409 fixed on the tip of the support rod 410 into contact with the vibration member 31.

Figure 10:
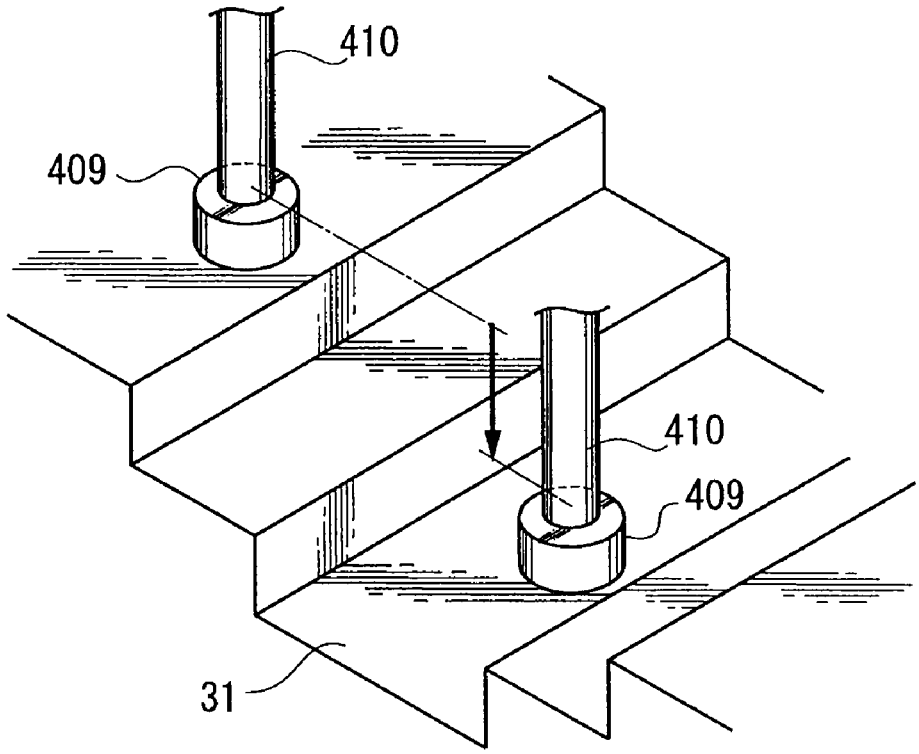
FIG. 10 is a perspective view illustrating an example of contact of a vibrator with a vibration member when the vibration member according to an embodiment of the present invention has an irregular shape.

As described above, the position of the vibration part 409 in the depth direction can be adjusted optionally. Therefore, for example, as shown in FIG. 10, even if the vibration member 31 has an irregular shape, the vibration part 409 and the vibration member 31 can be contacted with each other without fail. In other words, even if the height of one vibration member 31 in the depth direction varies corresponding to its position in the horizontal or vertical direction, the vibration part 409 and the vibration member 31 can be contacted with each other reliably by adjusting the height of the support rod 410 for each position.

In this case, information about the shape of the vibration member 31 may be stored as a table in the control unit or the like in advance. Thus, the position of the support rod 410 in the depth direction can be automatically adjusted to an appropriate one.

Figure 11:
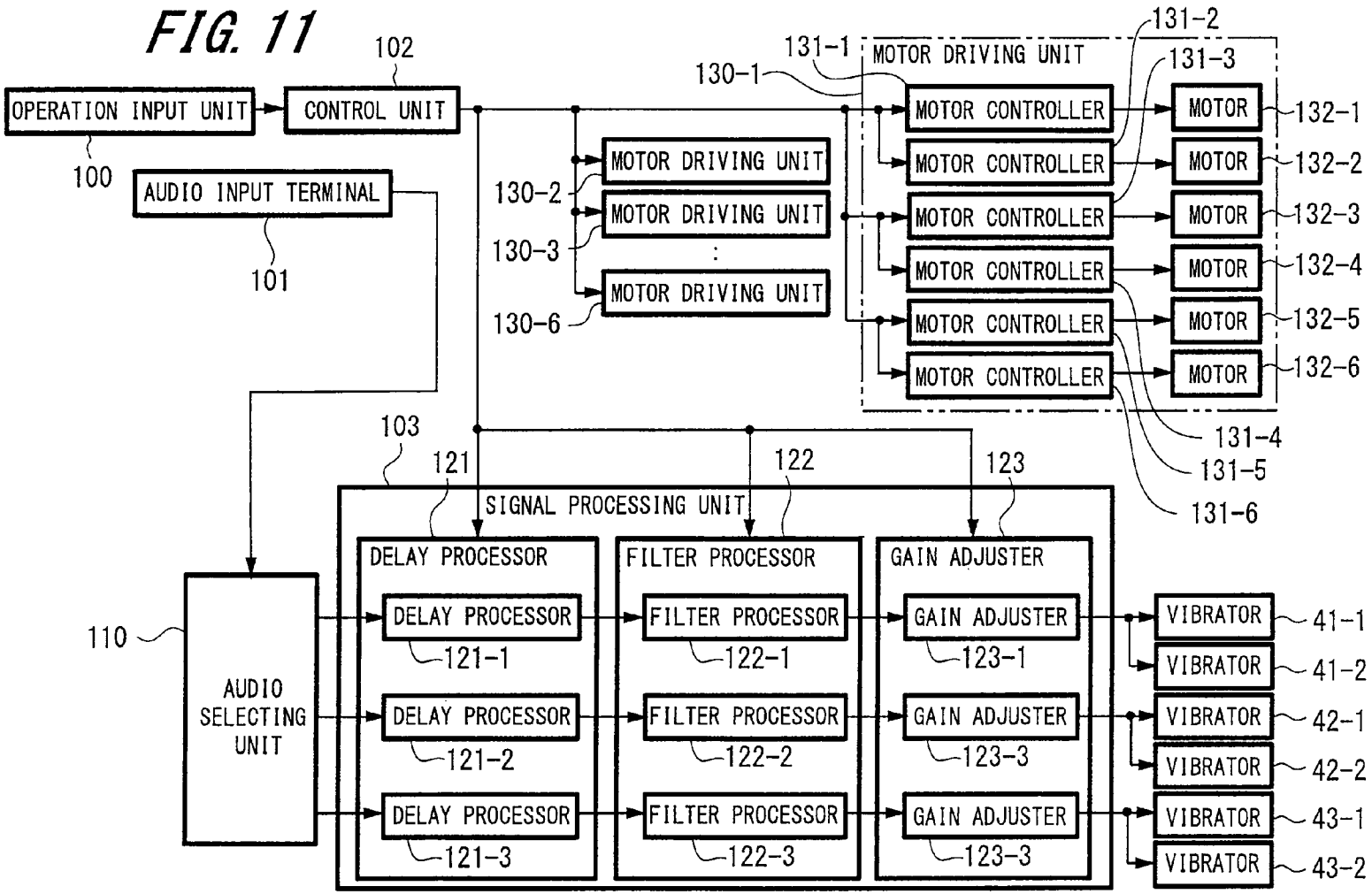
FIG. 11 is a block diagram illustrating an example internal configuration of a screen speaker apparatus according to an embodiment of the present invention.

Next, with reference to FIG. 11, an example of internal configuration of the screen speaker apparatus 11 will be described. In FIG. 11, portions corresponding to those described previously in FIG. 1 are given the same reference symbols and the descriptions thereof are omitted. In addition, in FIG. 11, the vibration member 31 and some other parts shown in FIG. 1 are not illustrated.

The screen speaker apparatus 11 includes an operation input unit 100, an audio input terminal 101, a control unit 102, a signal processing unit 103, an audio selecting unit 110, a motor driving units 130-1 to 130-6, and vibrators 41-1, 41-2, 42-1, 42-2, 43-1, and 43-2.

The operation input unit 100 includes a remote controller and so on and generates an operation signal corresponding to the contents of operation input by the user, outputting the operation signal to the control unit 102. The operation input unit 100 may include switches, buttons, and so on.

The audio input terminal 101 is connected to a reproducing apparatus for reproducing sounds from CDs (Compact Disc), DVDs (Digital Versatile Disc), or the like, a radio, a microphone, and so on. Thus, audio signals input from the audio input terminal 101 are supplied to the signal processing unit 103. The signal input terminal 101 receives an audio signal, such as one from any of 2-channel and 5.1-channel.

The control unit 102 generates control signals for controlling gains of sound output from the respective vibration members 31 and supplies the generated control signals to the audio selecting unit 110 and the signal processing unit 103. The control unit 102 generates drive signals for moving the respective motors 132-1 to **132-*n* in the predetermined directions based on the operation signals input from the operation input unit 100 and then supplies the generated drive signals to the respective motor driving units 130-1 and 130-6**.

The audio selecting unit 110 supplies the audio signal input from the audio input terminal 101 to each part of the signal processing unit 103 under the control of the control unit 102.

The signal processing unit 103 may be, for example, DSP (Digital Signal Processor) or MPU (Micro Processing Unit). The signal processing unit 103 performs predetermined processing on the audio signals input from the audio selecting unit 110 and the processed audio signal is then supplied to each of the vibrators 41-1, 41-2, 42-1, 42-2, 43-1, and 43-2.

Each of the vibrators 41-1, 41-2, 42-1, 42-2, 43-1, and 43-2 vibrates the vibration member 31, to which each vibrator is attached, in response to the audio signal supplied from the signal processing unit 103. As a result, the vibration member 31 outputs a sound. The details of the motor driving units 130-1 to 130-6 for moving the respective vibrators 41-1, 41-2, 42-1, 42-2, 43-1, and 43-2 in the horizontal, vertical, and depth directions will be described later.

The signal processing unit 103 includes delay processor 121, a filter processor 122, and a gain adjuster 123.

The delay processor 121 includes delay processors 121-1 to 121-3. Each of the delay processors 121-1 to 121-3 performs processing of causing a delay by a predetermined amount (delay processing) on an audio signal supplied from the audio input terminal 101, and supplies the audio signal on which the delay processing has been performed to the filter processor 122.

The filter processor 122 includes filter processors 122-1 to 122-3. The filter processors 122-1 to 122-3 perform predetermined filtering processing on audio signals supplied from the delay processors 121-1 to 121-3, respectively. Here, the term "filtering processing" means processing of allowing an audio signal with a predetermined frequency band to pass or to be blocked using a filter such as a FIR (Finite Impulse Response) filter or an IIR (Infinite Impulse Response) filter. Each of the filter processors 122-1 to 122-3 supplies the filtered audio signal to the gain adjuster 123.

The gain adjuster 123 includes gain adjusters 123-1 to 123-3. Each of the gain adjusters 123-1 to 123-3 performs gain adjusting processing on the audio signal supplied from each of the filter processors 122-1 to 122-3 upon receiving control signals supplied from the control unit 102. The gain adjusters adjust the gain of the input audio signal and limit the range of the level of the audio signal to be output.

The gain adjuster 123-1 supplies an audio signal on which the gain adjusting processing has been performed to each of the vibrators 41-1 and 41-2. The gain adjuster 123-2 supplies the audio signal on which the gain adjusting processing has been performed to the vibrators 42-1 and 42-2. The gain adjuster 123-3 supplies the audio signal on which the gain adjusting processing has been performed to the vibrators 43-1 and 43-2.

In the above embodiment, the delay processing, the filtering processing, and the gain adjusting processing are carried out in this order, but not limited to such an order. Alternatively, for example, the filtering processing may be carried out after the gain adjustment, followed by the delay processing at the last.

In the example described above, the delay processors 121, the filter processors 122, and the gain adjusters 123 perform predetermined processing on an audio signal supplied to the vibrators 41-1 and 41-2, 42-1 and 42-2, and 43-1 and 43-2, respectively. However, according to an embodiment of the present invention, part of them may not be performed, for example, and only the delay processing by the delay processors 121 may be performed on the audio signal.

In the above-described example, in order to facilitate the understanding of the description, the delay processor 121 is provided with the delay processors 121-1 to 121-3, the filter processor 122 is provided with the filter processors 122-1 to 122-3, and the gain adjuster 123 is provided with the gain adjusters 123-1 to 123-3. However, it is not limited to such a configuration. Alternatively, one processor (for example, the delay processor 121, the filter processor 122, or the gain adjuster 123) may perform each processing.

The motor driving units 130-1 to 130-6 include motors 132-1 to 132-6 and motor controllers 131-1 to 131-6 for driving the respective motors 132-1 to 132-6. The motor 132-1 and the motor 132-2 are driving mechanisms for moving the vibrators 41 in the direction y (see FIG. 7). Similarly, the motor 132-3 and the motor 132-4 are driving mechanisms for moving vibrators 41 in the direction x. In addition, the motor 132-5 and the motor 132-6 are driving mechanisms for moving the vibrators 41 in the direction z.

The motors 132-1 to 132-6 can be driven under the control of the motor controllers 131-1 to 131-6, respectively. The motor driving units 130-1 to 130-6 configured as described above can be driven in response to drive signals generated by the control unit 102 upon receiving operation signals input from the operation input unit 100. In other words, the motors 132-1 to 132-6 receive drive signals that indicate predetermined amounts of travels with the information about the user-specified positions on the vibration member 31 in the directions x, y, z, respectively. Subsequently, the motors 132-1 to 132-6 are driven to move the vibrators 41-1, 41-2, 42-1, 42-2, 43-1, and 43-2, respectively.

As configured above, the vibrators 41-1, 41-2, 42-1, 42-2, 43-1, and 43-2 can move to the respective positions input by the user through the operation input unit 100.

According to the above embodiment of the present invention, the vibrator 41 can automatically move to any position on the vibration member 31 in the horizontal and vertical direction. Therefore, such a movement of the vibrator 41 can facilitate the adjustment of sound quality, compared with one fixed on the vibration member 31 by an adhesive or the like.

According to the above embodiment of the present invention, the vibrator 41 can automatically move to any position on the vibration member 31 in the depth direction. Therefore, the sound quality can be adjusted by controlling the force of pressing the vibrator 41 against the vibration member 31.

In this case, the respective vibrators 41 in contact with the vibration member 31 can be adjusted to different heights in the depth direction, respectively. Thus, even if the vibration member 31 has an irregular shape, all of the vibrators 41 can be brought into contact with the surface of the vibration member 31 to vibrate.

According to the above embodiment, an optional number of vibrators 41 can be attached to the rail 403 of the vibrator moving mechanism 60. In addition, the number of rails 403 may also be changed if necessary. Therefore, two or more optional positions on the vibration member 31 can be vibrated. In other words, the sound quality can be more carefully adjusted.

According to the above embodiment, like this example, when the vibration members 31 are formed of two or more panel members, each of them may have a different number of vibrators 41. In this case, therefore, adjacent panel members may be different in number of positions vibrated. In other words, the vibrators 21 may be attached to each of the panel members in any of various ways. For example, two vibrators 41 may be attached to each of the panel members adjacent to each other in the vertical direction. Alternatively, for example, four vibrators 41 may be attached to the upper panel member but any vibrators may not be attached to the lower panel member.

Figure 12B:
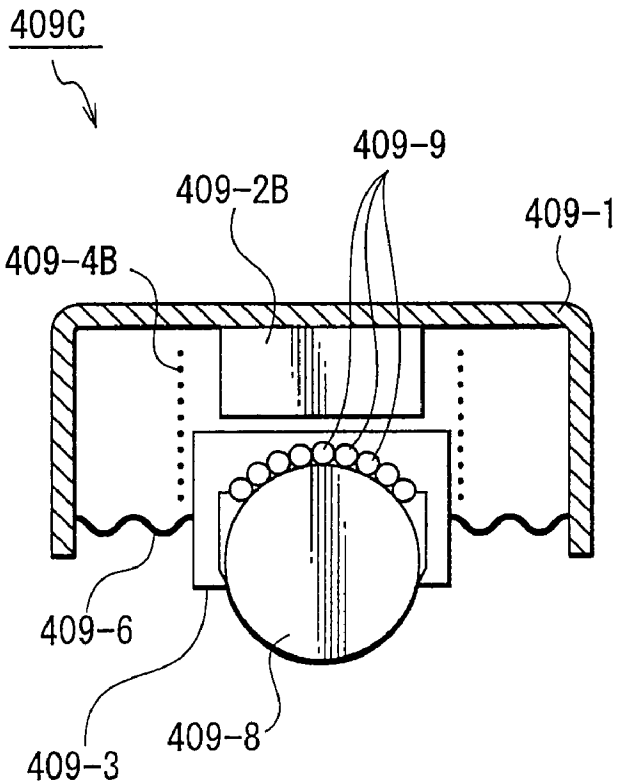
FIGS. 12A and 12B illustrate an example configuration of a vibrator according to another embodiment of the present invention, where
Figure 12A:
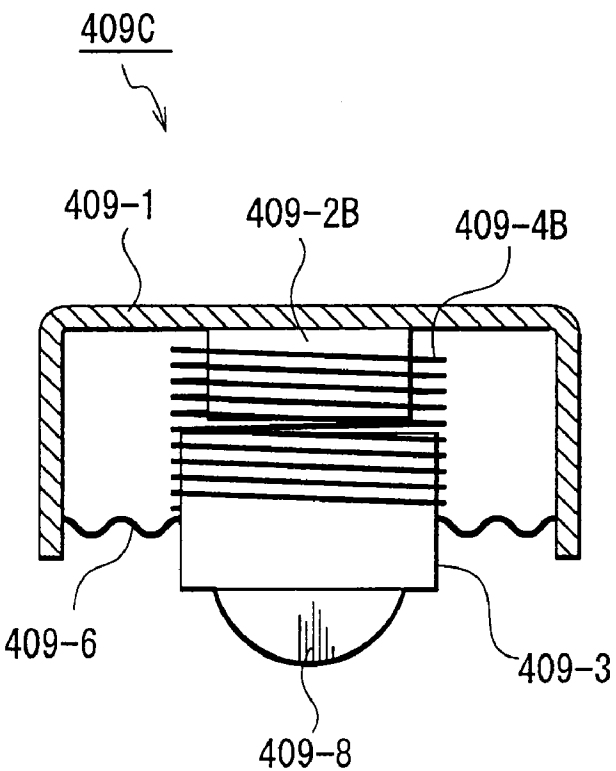

In the example of the vibrators 41 according to the above embodiment, the surface of each vibrator 41 is brought into contact with the surface of the vibration member 31 through the contact surface 409-5. However, the placement of the vibrators 41 is not limited thereto. For example, the vibrator 41 may be in the form of a ball caster so that the vibrator 41 can be point-contact with the vibration member 31. An example configuration of the vibrator 41 in this case is shown in FIGS. 12A and 12B. FIG. 12A is a side view and FIG. 12B is a sectional view of a vibrator. In FIG. 12, the same reference symbols are given to portions corresponding to those in FIGS. 2 to 4.

A vibration part 409C shown in FIGS. 12A and 12B includes a magnet 409-2B housed in a case 409-1, a coil bobbin 409-3 arranged close to the magnet 409-2B, and a coil 409-4B wound around the coil bobbin 409-3. The coil bobbin 409-3 is attached to the case 409-1 using a damper 409-6 so that the angle of the coil bobbin 409-3 is changed. With such a configuration of the vibration part 409C, a signal is applied to the coil 409-4B wound around the coil bobbin 409-3. A coil magnetic field is generated in response to the applied signal and acts with a bias magnetic field of the magnet 409-2 to cause the coil bobbin 409-3 to vibrate.

A ball 409-8 and ball bearings 409-9 are housed in the coil bobbin 409-3. The ball 409-8 is point-contact with the vibration member 31. The ball-bearings 409-9 are responsible for efficiently transmitting the vibration of the coil bobbin 409-3 to the ball 409-8. Since the vibration part 409C is configured as described above, vibration generated due to the composite magnetic field of the bias magnetic field and the coil magnetic field is transmitted to the vibration member 31, causing the vibration member 31 to output a sound.

Figure 13:
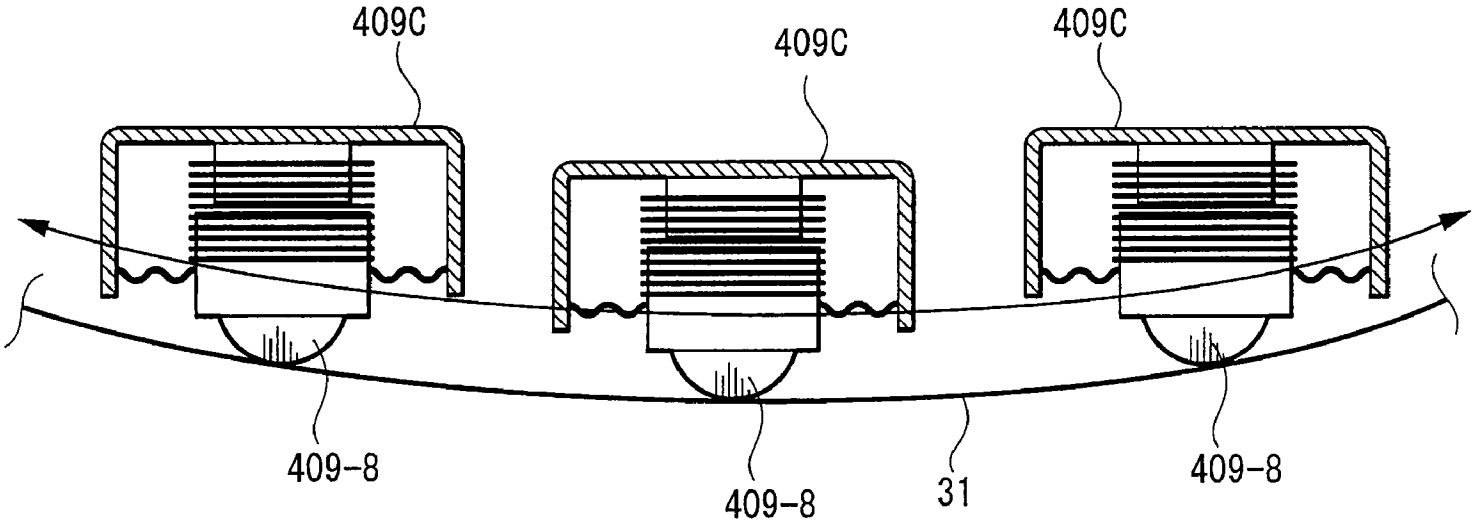
FIG. 13 is a perspective view illustrating an example configuration of a screen speaker apparatus according to another embodiment of the present invention.

As described above, since the vibrator 41 is in the form of a ball caster, the vibrator 41 can be moved to any of the positions on the vibration member 31 in the directions x, y, z while being in contact with the vibration member 31. Therefore, for example, even if the vibration member 31 has a curved surface as shown in FIG. 13, the vibrator 41 can be moved while being in contact with the vibration member 31. In this case, each of the motors 132 should be controlled so that the force of pressing the vibrator 41 against the vibration member 31 can be exerted in the direction tangent to the surface of the vibrator 41.

By forming the vibrator 41 into a ball caster shape as shown in FIGS. 12A and 12B, the vibrator 41 can be moved while being in contact with the vibration member 31 even when the vibration member 31 has an irregular shape as shown in FIG. 10. In other words, there is no need of detaching the vibrator 41 from the vibration member 31 before the movement. Therefore, the vibration member 31 can keep on generating sounds while the vibrator 41 is being moved. Thus, the adjustment of sound quality can be continuously performed in terms of time. In other words, the user can adjust the position of the vibrator 41 while checking a subtle change in sound quality.

In the case where the vibrator 41 is in the form of a ball caster, a mechanism for pressing the vibrator 41 against the vibration member 31 may be a spring or the like. In such case, the force of pressing the vibrator 41 against the vibration member 31 can be controlled by spring expansion and contraction. Such a configuration of the mechanism eliminates the use of the support rod 410 for adjusting the position of the vibration part 409 in the depth direction and the motor for moving the support rod 410. In other words, the mechanism for adjusting the vibration part 409 in the depth direction can be simplified, leading to a reduction in production costs of the audio output apparatus.

In addition, the vibrator 41 in the form of a ball caster allows the use of a vibration member with a curved surface as shown in FIG. 13. The use of such a vibration member leads to a spread of sound output from the screen speaker apparatus 11 can be extended more.

The above embodiment of the present invention has been described using the screen speaker apparatus 11 with a self-standing structure as an example. However, the configuration of the screen speaker apparatus 11 is not limited to such an example. Alternatively, for example, the screen speaker apparatus 11 may be attached to and hanged from a rail on a ceiling or the like. An example configuration of such screen speaker apparatus 11' is shown in FIG. 14.

Figure 14:
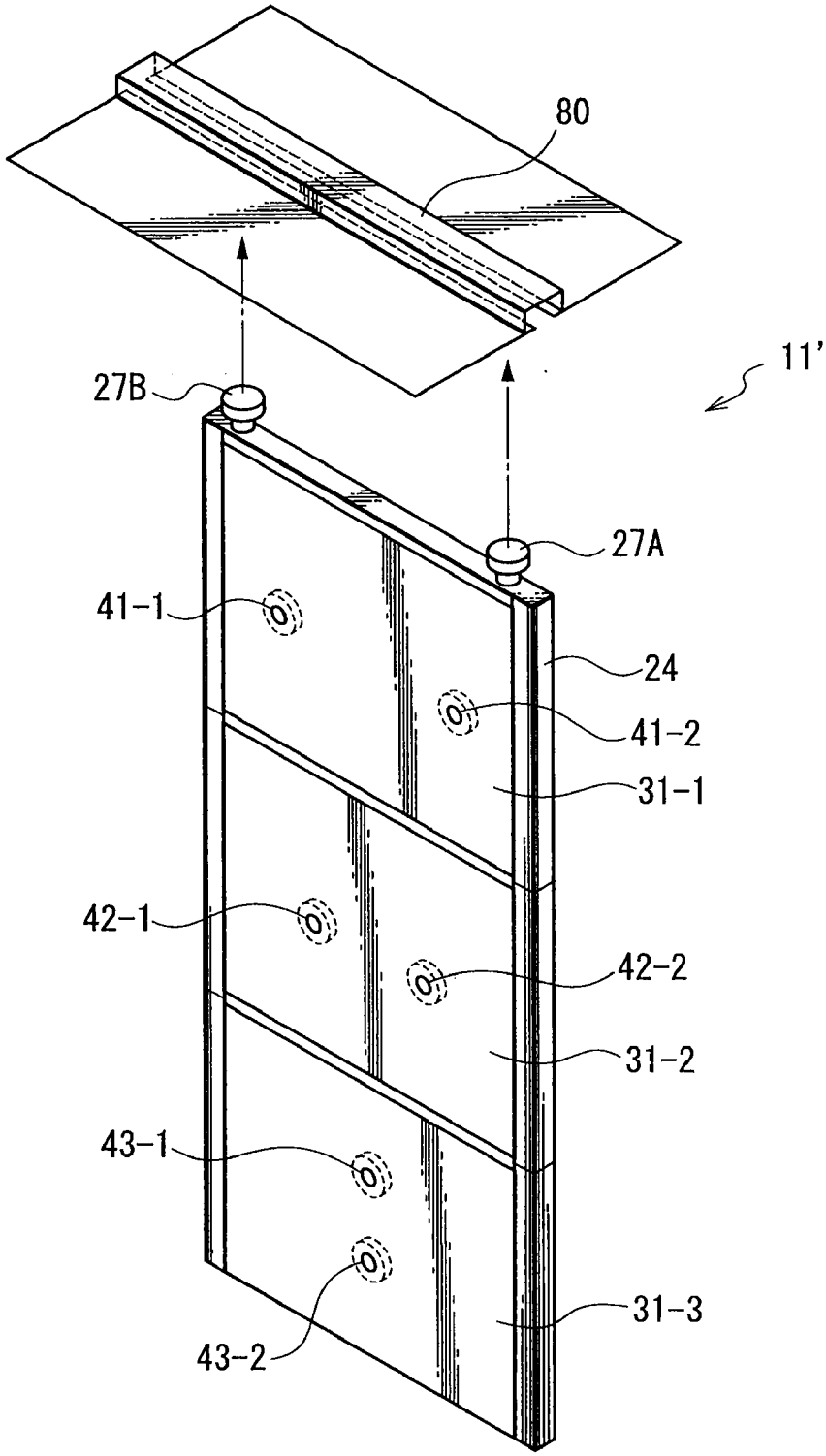
FIG. 14 is a perspective view illustrating an example configuration of a screen speaker apparatus according to another embodiment of the present invention.

In FIG. 14, the same reference symbols are given to portions corresponding those described in FIG. 1 and descriptions thereof are omitted. The screen speaker apparatus 11' shown in FIG. 14 includes wheels 27A and 27B at the upper end of the vibration member 31. Each of the wheels 27A and 27B has a shape which can be fit into a rail 80 on a ceiling, wall surface, or the like. The screen speaker apparatus 11' is supported in the form of being hung from the rail 80 by fitting the wheels 27A and 27B in the rail 80.

In the screen speaker apparatus 11' supported in this configuration, the rail 80 may be formed a little longer so that each of the wheels 27A and 27B can slide on the rail 80.

Such a configuration of the screen speaker apparatus 11' allows itself to stand upright by hanging the vibration member 31, even if the vibration member 31 is made of steel or other heavy materials and may not be supported by only the wheels 22A to 22D or the apparatus supports 23A to 23D (see FIG. 1).

Figure 15:
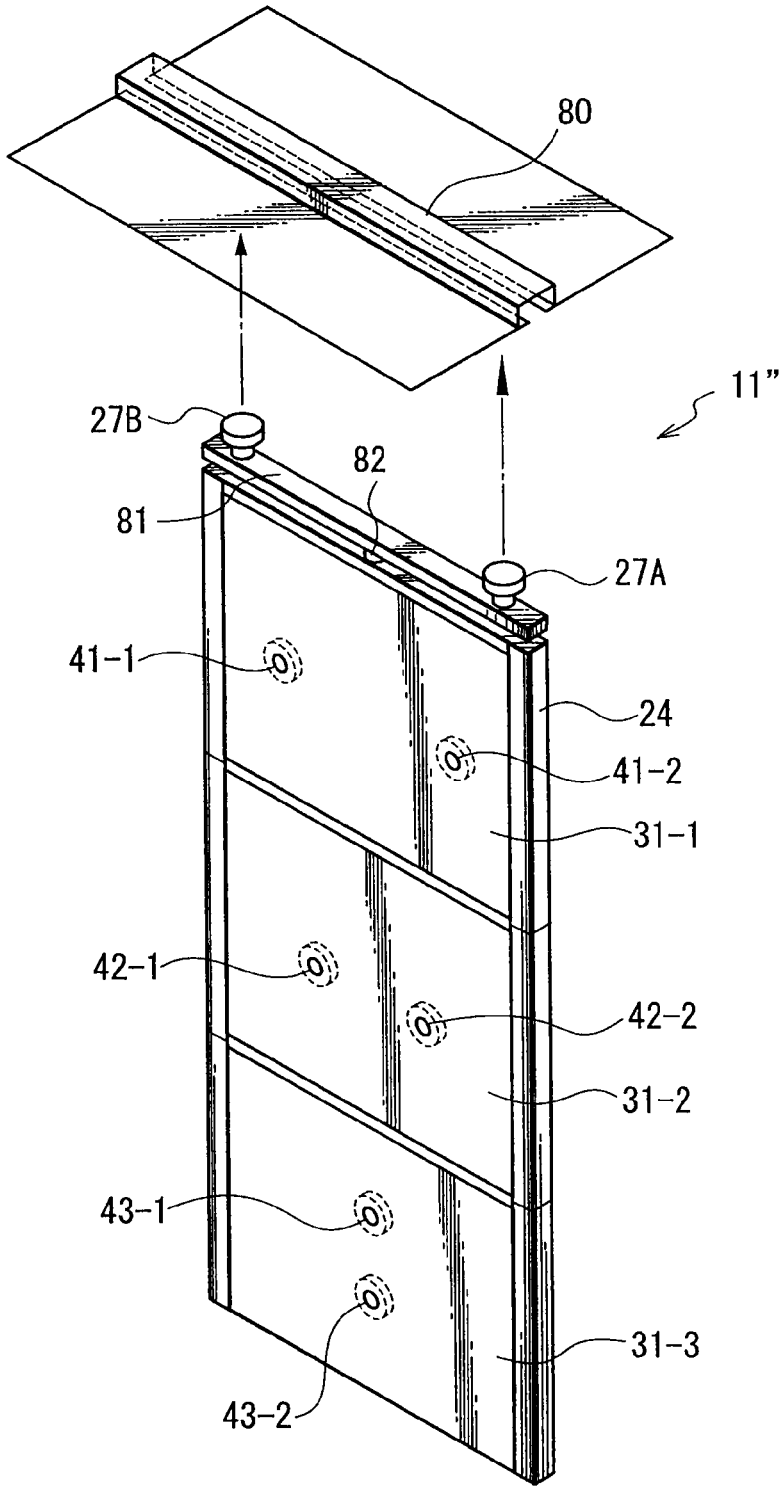
FIG. 15 is a perspective view illustrating an example configuration of a screen speaker apparatus according to another embodiment of the present invention.

Furthermore, when the screen speaker apparatus 11' is of a shape hanging from a ceiling, the vibration member 31 may be designed to be movable in the rotation direction. FIG. 15 illustrates an example configuration of such a screen speaker apparatus 11".

In FIG. 14, the same reference symbols are given to portions corresponding those described in FIGS. 1 and 14 and descriptions thereof are omitted. In the screen speaker apparatus 11" shown in FIG. 15, the wheels 27A and 27B are attached to the upper part of a wheel attaching part 81 on the top of a vibration member 31. Here, the wheel attaching part 81 is formed independently from the vibration member 31 as shown in FIG. 15. In addition, the wheel attaching part 81 and the vibration member 31 are connected via a rotation axis 82 extending in the vertical direction.

The wheel attaching part 81 is a plate-like member with substantially the same thickness as that of the vibration member 31. The height of the wheel attaching part 81 in the vertical direction is set to a fraction of the height of the vibration member 31. The rotation axis 82 is located at the position substantially half the width of the vibration member 31 and allows the vibration members 31 to rotate 360 degrees in the horizontal direction.

With such a configuration, the vibration member 31 can rotate about the rotation axis 82. Therefore, the user can turn the screen speaker apparatus 11" to face in any direction, such as one where the user is located.

It should be understood by those skilled in the art that various modifications, combinations, sub-combinations and alterations may occur depending on design requirements and other factors insofar as they are within the scope of the appended claims or the equivalents thereof.

What is claimed is:

1. An audio output apparatus, comprising:

a vibration member that vibrates to output a sound;

a vibrator in contact with the vibration member detachably attached thereto to allow the vibration member to vibrate in response to an input audio signal;

a vibrator positioning unit that controls a contact position between the vibrator and the vibration member; and a vibrator-depth positioning unit that adjusts a position of the vibrator in the direction of being pressed against the vibration member and brought into contact with the vibration member, wherein the vibration member extends in a first and second direction and vibrates in a third direction, and the vibrator positioning unit is configured to change a location of the vibrator with respect to at least one of the first and second directions in which the vibration member extends.

2. The audio output apparatus according to claim 1, wherein the vibrator positioning unit includes:

a horizontal drive unit that moves the vibrator in the horizontal direction of the vibration member; and a vertical drive unit that moves the vibrator in the vertical direction of the vibration member.

3. The audio output apparatus according to claim 2, further comprising:

a control unit that generates a drive signal for driving the vibrator positioning unit and the vibrator-depth positioning unit upon receiving position information input by a user, wherein the vibrator positioning unit and the vibrator-depth positioning unit are driven in response to the drive signal.

4. The audio output apparatus according to claim 3, wherein the vibrator includes a ball as a portion in contact with the vibration member.

5. The audio output apparatus according to claim 4, wherein the vibrator-depth positioning unit includes an elastic material that presses the vibrator against the vibration member.

6. The audio output apparatus according to claim 3, wherein the vibrator includes a vibration part that vibrates in response to the audio signal, and a support rod attached to the vibration part at a right angle to the vibration member; and wherein the vibrator-depth positioning unit is a mechanism that changes a position at which the support rod is held.

7. The audio output apparatus according to claim 3, wherein the vibrator includes:

a giant-magnetostrictive element;

a magnet that applies a bias magnetic field to the giant-magnetostrictive element; and a coil that applies a current to the giant-magnetostrictive element.

8. The audio output apparatus according to claim 3, further comprising:

a table in which information about the shape of the vibration member is described, wherein the control unit calculates a moving amount of the vibrator based on position information described in the table and generates the drive signal based on the moving amount calculated.

9. The audio output apparatus according to claim 3, wherein the vibrator positioning unit includes: a first rail attached in the vertical direction of the vibration member and having a rack-shaped portion formed on one side thereof; a second rail attached perpendicularly to the first rail and having opposite ends with wheels that engage with the rack-shaped portion; and a vibrator-moving unit having a wheel at an end thereof that engages with a rack-shaped portion formed on the second rail.

10. The audio output apparatus according to claim 9, wherein the vibrator-depth positioning unit is integrally formed with the vibrator positioning unit.

11. The audio output apparatus according to claim 10, further comprising:

a frame to which the vibration member is attached, wherein the vibrator positioning unit and the vibrator-depth positioning unit are attached to a side of the frame, which is opposite to the side on which the vibration member is attached, so that the vibrator is brought into contact with the vibration member.

12. A vibrator comprising:

a ball as a portion in contact with a vibration member that vibrates to output a sound, wherein the portion is detachably attached to the vibration member and allowed to vibrate the vibration member in response to an input audio signal.

13. The audio output apparatus according to claim 1, wherein the contact position is a location on the vibration member at which the vibrator makes contact, and the vibrator positioning unit is configured to change the location on the vibration member at which the vibrator makes contact.

14. The audio output apparatus according to claim 1, wherein the vibrator positioning unit is configured to change the location of the vibrator with respect to both the first and second directions in which the vibration member extends.

* * * * *